US010442650B2

(12) United States Patent
Andresen

(10) Patent No.: US 10,442,650 B2
(45) Date of Patent: Oct. 15, 2019

(54) METHOD FOR ROLLING UP DEFINITE LENGTHS OF MATS IN UNIDIRECTIONAL ROLLED ROLLS, AND A MAT ROLLING STATION FOR PERFORMING THE METHOD

(71) Applicant: Inwatec ApS, Odense SV (DK)

(72) Inventor: Mads Andresen, Odense SV (DK)

(73) Assignee: INWATEC APS (DK)

( * ) Notice: Subject to any disclaimer, the term of this patent is extended or adjusted under 35 U.S.C. 154(b) by 628 days.

(21) Appl. No.: 15/170,892

(22) Filed: Jun. 1, 2016

(65) Prior Publication Data

US 2017/0113893 A1 Apr. 27, 2017

(30) Foreign Application Priority Data

Oct. 22, 2015 (DK) ..... 2015 70686

(51) Int. Cl.
*B65H 19/22* (2006.01)
*B65H 18/16* (2006.01)
*B65H 18/02* (2006.01)

(52) U.S. Cl.
CPC ..... *B65H 19/2276* (2013.01); *B65H 18/023* (2013.01); *B65H 18/16* (2013.01);
(Continued)

(58) Field of Classification Search
CPC ..... B65H 18/16; B65H 19/2276; B65H 19/2238; B65H 19/2246; B65H 19/30;
(Continued)

(56) References Cited

U.S. PATENT DOCUMENTS 4,573,644 A * 3/1986 Brown ..... B65H 18/22 242/541.2
4,973,010 A * 11/1990 Brown ..... B65H 18/22 242/533

(Continued)

FOREIGN PATENT DOCUMENTS

DE 469675 C * 12/1928 ..... B65H 18/20
EP 2837588 A2 * 2/2015 ..... B65H 18/14

(Continued)

OTHER PUBLICATIONS

Japanese Office Action, Patent Application No. 2018-520471, dated Mar. 1, 2019, 7 pages.

(Continued)

*Primary Examiner* — William E Dondero
(74) *Attorney, Agent, or Firm* — Ware, Fressola, Maguire & Barber LLP

(57) ABSTRACT

Method for rolling up definite lengths of a mats in a unidirectional rolled roll, where mats are advanced one after another into a rolling mechanism in flattened out condition and released from the mechanism in rolled up condition. A rolled up mat is ejected from the rolling mechanism and caused to roll out therefrom on top of a succeeding flattened out mat which advances towards the rolling mechanism. A mat rolling station for performing the method is provided, where a ramp conveyer is provided which advances a flattened mat towards the rolling mechanism. At the rolling mechanism, bending conveyers are provided for advancing the forwardly moving mat sections into a circular bend on the ramp conveyer. A difference of surface speeds of the bending conveyers and the ramp conveyer is controllable by a signal provoked by the advance of a succeeding mat on the ramp conveyer before the rolling mechanism.

8 Claims, 7 Drawing Sheets

(52) U.S. Cl.
CPC ... *B65H 19/2269* (2013.01); *B65H 2301/324* (2013.01); *B65H 2301/41376* (2013.01); *B65H 2301/41429* (2013.01); *B65H 2404/256* (2013.01); *B65H 2404/432* (2013.01); *B65H 2408/235* (2013.01); *B65H 2511/51* (2013.01); *B65H 2513/106* (2013.01); *B65H 2513/108* (2013.01); *B65H 2553/414* (2013.01); *B65H 2701/1922* (2013.01)

(58) Field of Classification Search
CPC ..... B65H 2553/414; B65H 2404/432; B65H 2404/256; B65H 2301/324; B65H 2301/41429; B65H 2701/1922; B65H 2511/51
See application file for complete search history.

(56) References Cited

U.S. PATENT DOCUMENTS

| | | | | |
|---|---|---|---|---|
| 8,444,079 | B2 * | 5/2013 | Akpan | B65H 18/22 242/535.1 |
| 8,702,027 | B2 * | 4/2014 | Akpan | B65H 18/22 242/535.1 |
| 8,960,587 | B2 * | 2/2015 | Akpan | B65H 18/22 242/535.1 |
| 9,346,642 | B2 * | 5/2016 | Akpan | B65H 18/22 |
| 9,884,694 | B2 * | 2/2018 | Akpan | B65B 5/04 |
| 2011/0180651 | A1 * | 7/2011 | Akpan | B65H 18/22 242/535.1 |
| 2012/0298787 | A1 * | 11/2012 | Akpan | B65H 18/22 242/541.3 |
| 2013/0240659 | A1 * | 9/2013 | Akpan | B65H 18/22 242/548 |
| 2014/0075887 | A1 * | 3/2014 | Akpan | B65B 5/04 53/430 |
| 2015/0097067 | A1 * | 4/2015 | Akpan | B65H 18/22 242/535.4 |
| 2018/0148202 | A1 * | 5/2018 | Akpan | B65B 5/04 |

FOREIGN PATENT DOCUMENTS

| | | | |
|---|---|---|---|
| EP | 2822712 B1 * | 5/2016 | B21C 47/3425 |
| JP | 60-167035 | 11/1985 | |
| JP | 63-247249 | 10/1988 | |
| JP | 6-298414 | 10/1994 | |

OTHER PUBLICATIONS

English translation of Japanese Office Action, Patent Application No. 2018-520471, dated Mar. 1, 2019, 6 pages.
English Abstract, JP63-247249, 1 page.
English Abstract, JP6-298414, 1 page.

* cited by examiner

METHOD FOR ROLLING UP DEFINITE LENGTHS OF MATS IN UNIDIRECTIONAL ROLLED ROLLS, AND A MAT ROLLING STATION FOR PERFORMING THE METHOD

CROSS-REFERENCE TO RELATED APPLICATIONS

This application claims priority to Danish Patent Appl. No. PA 2015 70686 filed Oct. 22, 2015, which is hereby incorporated by reference in its entirety.

BACKGROUND

In prior art methods for rolling mats into compact configuration, a mat is advanced in flattened out condition on a conveyer into the rolling mechanism, rolled up, is released from the rolling mechanism and travels away from the rolling mechanism on the same conveyer on which it entered the rolling mechanism. Then the mat is picked up by an operator for placement and storage. The operator is only able to enter the next mat into the machine when the previous rolled up mat has been removed. This leaves the rolling mechanism idle while the rolled up mat is substituted with a new, flattened out mat. Also, it leaves the operator idle during the rolling up operation, as a new mat can only be entered, in flattened out condition, when the rolling mechanism is empty.

It has also been observed with present day mat rolling machinery, that occasionally the mat fails to be rolled in the same direction throughout the roll, but will initially be rolled in an S-configuration. This is highly undesirable as the S-fold at the center of the rolled mat will cause the edge of the mat to fail to lie flat on the floor, when the mat is deployed. Mats which, when deployed, fail to flatten out, but remain elevated at points such as at the edges, poses a severe health hazard, as people may easily be tripped at the folded up portions of such mats, and sustain serious injury.

The invention seeks to alter prior art mat rolling mechanisms, in order to enhance productivity and also in order to improve the performance quality wise, of present day mat roller stations.

SUMMARY

According to a first aspect of the method, mats are advanced one after another into a rolling mechanism in flattened out condition and released from the mechanism in rolled up condition, and when a rolled up mat is ejected from the rolling mechanism and caused to roll out therefrom, it will roll away from the mechanism on top of a succeeding flattened out mat which advances towards the rolling mechanism.

The operator may now proceed in the following way:

a) serve a mat in flattened out condition, even if an already rolled up, or nearly rolled up mat is present in the mat rolling mechanism, and observe the rolled up mat exit to a position on top of the just served mat, b) without any idle time he then may pick up the rolled mat from its position on top of the mat being served at the mechanism, and place the rolled up mat in a stack, and immediately proceed to point a).

In this way neither the operator, nor the mat rolling mechanism idles at any time, and productivity is greatly enhanced.

In order to further enhance productivity of the mat rolling process, the eject action is provoked automatically by the advance of a succeeding flattened out mat toward the rolling mechanism. This provocation can be by way of a physical action directly on the rolling mechanism, where the leading edge of an advancing mat causes the ejection or it may be by way of a switch being flipped by the edge, or it may be by way of a remote sensing device using light, sound or other radiated energy to determine the presence of a mat on the advance ramp. In this way the operator need not pay much attention to the mat rolling mechanism, but can at any time proceed with entering a new mat. If a mat is present in the mechanism, it will eject automatically, and if no mat is present an eject action has no consequence.

In a preferred embodiment of the method, the mats are advanced towards the mat rolling mechanism on an upwardly inclined ramp, and the rolled up mats which eject from the rolling mechanism roll down the inclined ramp conveyer. Thus the mat rolling mechanism will be situated at a higher level than the starting point of the ramp, and rolled up mats ejected from the mat rolling mechanism may be advanced toward the starting point of the ramp by gravitational pull. This ensures a swift motion of the ejected rolled up mats, so the operator shall not have to wait for them, even though the mat on its way up the ramp will be moving in the opposite direction of a rolled up mat which leaves the mechanism.

In accordance with this or other exemplary embodiments of the method, the rolled up mat in the rolling mechanism is advanced at an input side with a predetermined input speed, and at the same time advanced at an output side with a predetermined output speed. As long as the input and output speeds are the same, the rolled up mat will stay in the mechanism, however if the mat is advanced faster at the output side than at the input side, the mat will be repelled from the rolling mechanism.

In the present case, the input speed is defined by a conveyer which forms at least a part of the surface of the inclined ramp, which conveyer also advances the flattened mat towards the rolling mechanism. At, and inside the rolling mechanism, the conveyer of the inclined ramp is termed input conveyer. The output speed is defined by moving surfaces advancing the side of the rolled up mat facing away from the ramp conveyer here, and these moving surfaces may comprise rollers, brush-clad rollers or other types of conveyers. The conveyers defining the output side shall be termed bending conveyers. In the following the "speed" of a conveyer designates the speed by which the conveying surface of the conveyer moves. In order for the rolling up of the mat to take place, these conveyer surfaces move in the opposite direction with respect to the surfaces of the input conveyers. In order to generate an eject action, the relative speeds of the input and bending conveyers must be controlled in such a way that the bending conveyers are moving faster than the input conveyers. This causes the rolled up mat to leave the rolling mechanism while still spinning around its center. It should be mentioned that this way of ejecting a rolled up mat, from a rolling mechanism, will work whether or not the rolled up mat leaving the mechanism, rolls out on top of a flattened mat entering the mechanism. In more automated gear, pick up mechanisms for gripping and advancing the rolled up mat away from the rolling mechanism could easily be employed, so a leaving rolled up mat would not necessarily come out and roll directly on top of an entering flat mat, and also mats might enter automatically from a feeding conveyer.

In accordance with this or other exemplary embodiments of the method, the mat is advanced into the rolling mechanism along the inclined ramp, and then in the rolling mechanism a mat section is advanced in a direction perpendicular to the ramp. After the mat section is advanced parallel to the ramp to oppose the input direction towards a lower end of the ramp, and finally the mat section is advanced downwards towards the mat surface, which mat surface is advancing up the ramp, thereby forming an initial curl. The advancement of a mat section downwards towards the mat surface occurs at a predetermined distance from the mat surface on the ramp when forming the initial curl of a roll, and as further layers are added, the diameter of the innermost layer is made gradually smaller and possibly reduced further after the entire mat has entered the rolling mechanism. Here moving surfaces or conveyers propel the moving mat to form a circular continuous bend. If we follow the action on a leading edge of a mat, this edge is firstly lifted upwards and away from the input conveyer, then it is propelled backwards against the moving direction of the mat advancing along the input conveyer, and lastly the leading edge is caused to move downward to finally contact a mat surface of the same mat, but some distance away from the leading edge thereof. As the mat surface which the leading edge contacts is also moving, a first layer of a curled or rolled up mat has now been formed. All sections of the mat after the leading edge will undergo similar action and thereby ad layer upon layer onto the initially formed curl.

Studies have shown that under certain conditions a circular continuous bend does not form initially, but an S-shaped bend forms. Here the leading edge does not contact the mat correctly below the mechanism for pressing the leading edge downward, but contacts the mat surface further down the mat in the direction of the trailing edge. When this happens, the leading edge will bend backwards and cause an S-shape to be formed centrally in the rolled up mat. In order to avoid this, it is vital to manage the size of the first circular curl, such that it is formed with minimum stresses in the mat material. Once a first circular bend or curl has been formed, the circular bend may be made gradually smaller, as further layers of mat material are rolled onto the first curl. This is done by gradually diminishing the distance between the input conveyer and the members which initially urged the leading edge towards the input conveyer. This action is performed while still further layers of mat are rolled onto the roll. When the mat is fully rolled up, and the trailing edge has been rolled onto the mat roll, usually its final most compressed condition has been reached, however, it may be, that further compression is required. It is to be noticed also that as further layers build op on the roll, it also grows in diameter, but due to the fact that the first curl on the roll is made large, and during further build-up of layers this first curl is made smaller, the final roll may have a smaller or larger outer diameter, than the diameter of the first layer of mat roll which is initially produced.

This method of avoiding S-bends on the leading edge may be performed at any rolling mechanism. It only requires that one takes care to start out with a rather large curl or circular section, then, gradually make it smaller as consecutive layers build onto the roll.

The minimum size of an initial curl, such as measured by its mean diameter, which may be formed without the curl deteriorating into an S-curl, may be determined by a combination of the mat properties, such as mat bending resilience, mat thickness and mat weight per area measure. A test to determine this minimum size of the initial roll and thus the optimal driving parameters for the mat rolling station may easily be performed. To obtain the measure for a given mat, it is placed on a plane flat horizontal surface and folded in two equally long plies along a straight line perpendicular to the length direction of the mat. Hereby a bead will form along the fold line and the size of this bead measured as its height from the surface will correlate to the minimum diameter size of the initial roll or first curl made when rolling up the mat. The first curl diameter should not be smaller than half the bead measure, and preferably it is adjusted to form in the range between the bead measure and twice the bead measure.

The surfaces, which contact the mat roll in the mat rolling mechanism, are preferably all moving. Guide surfaces, on which the mat roll or partially finished mat roll glides, are known from prior art and may be used also however, they have a tendency to un-roll the rolled up mat as they work contrary to the rolling action.

It is preferred that the compression action by way of which the formed initial first layer of a roll is caused to diminish, is a constant pressure, and that it effects the rolled up mat by the action of one roller-conveyer. This one roller conveyer comprise a single driven roll which, while it advances a surface section of the mat roll, it simultaneously pressurizes this mat roll surface towards the center of the mat roll under formation.

In a further aspect the invention, a mat rolling mechanism for performing the above method is provided. In this mechanism the inclined ramp comprise a conveyer which advance the flattened mat towards the rolling mechanism, and at the rolling mechanism, bending conveyers are provided which advances the forwardly moving mat sections into a circular bend on the ramp conveyer. The difference of surface speeds of the bending conveyers and the ramp conveyer is controlled by a signal which is provoked by the advance of a succeeding mat on the ramp conveyers before the rolling mechanism. The surface speeds of the conveyers are important, as they determine whether or not the rolled up mat stays in the mechanism or is ejected. By controlling this speed difference by way of a signal which is provoked by the advance of the next mat to the rolling mechanism, the ejection may be timed automatically and without operator input to the mechanism. The rolled up mat inside the rolling mechanism may herby be ejected at the exact right time for the operator to take it in hand and add it to a suitable store.

In an embodiment, a bending conveyer at the rolling mechanism is provided, which causes a mat section to be advanced towards the ramp conveyers, and the distance between the moving surfaces of this conveyer and the ramp conveyers is controllable. This conveyer, which is movable to and from the ramp, is preferably a roller conveyer, comprising a single roller with a yieldable surface. This surface preferably comprises resilient brush hears, standing radially away from a cylindrical surface of a roll driven to rotate about its center axis. In this way a flexible, yet resilient touch advances the surface of the mat being rolled into a rolled up state. The particular surface, which is responsible for the tightening action of the mat in the mechanism, belongs to a roller conveyer, hereafter named curl conveyer, which is pivotally mounted around a hinge point, such that the axis thereof may perform an arched movement perpendicular to the rotation axis of the cylindrical body of the curl conveyer.

Preferably the hinge point coincide with the center of a bearing which carries the drive wheel for a belt drive which imparts the rotational movement to effect the curl conveyer to rotate about the center axis thereof. A belt drive is suggested here but a wheel drive such as gears or toothed wheels could be used. The pivotal action of the curl conveyer is performed between a lowermost point, and an uppermost point. At the uppermost point the largest possible mat roll may fit in between the surface of the input conveyer and the surface of the curl conveyer. At the lowermost point the curl conveyer is at its closest to the surface of the input conveyer, and the smallest possible mat roll may be made. The weight of the curl conveyer and its drive and pivot arm urges the conveyer constantly towards the lowermost point and possibly added weight directly onto the pivot arm or an extension thereof may either enhance or lighten the downward gravitational force of this conveyer.

An actuator is provided at a chassis at one or each end of the curl conveyer, such that the downward urge of the pivotally mounted curl conveyer may be controlled. When the mat rolling mechanism receives a new mat to be rolled, the actuator is caused to lift the curl conveyer up along its pivotal path to define a diameter of an initial curl or first and innermost layer of a mat to be rolled. Once this layer is formed and further layers are about to form, the actuator may retreat while at the same time, layers are added and the innermost circular curl retracts gradually to an ever smaller diameter under the downward weight of the curl conveyer.

The mat roller mechanism here, may enhance the productivity of mat rolling both by ensuring that S-shapes are not produced in the mat and by ensuring that a mat roll exits the mechanism, when a new mat is advancing towards it. Also the sped difference of the conveyers in the mechanism, which is responsible for the exit or eject action may ensure, that a roll ejects with a rotational inertia, such that even after it has been ejected, such a roll may well advance a reasonable distance away from the mat roller mechanism.

BRIEF DESCRIPTION OF THE DRAWINGS

The embodiments of the disclosure, together with their advantages, may be best understood from the following detailed description taken in conjunction with the accompanying figures, which are given by way of illustration only, and thus, they are not limiting the disclosure. The figures are schematic and simplified for clarity, and they just show details to improve the understanding of the claims, while other details may be left out. Throughout, the same reference numerals are used for identical or corresponding parts. The individual features of each aspect may each be combined with any or all features of the other aspects. These and other aspects, features and/or technical effects will be apparent from and elucidated with reference to the illustrations described hereinafter in which:

DETAILED DESCRIPTION

Figure 1:
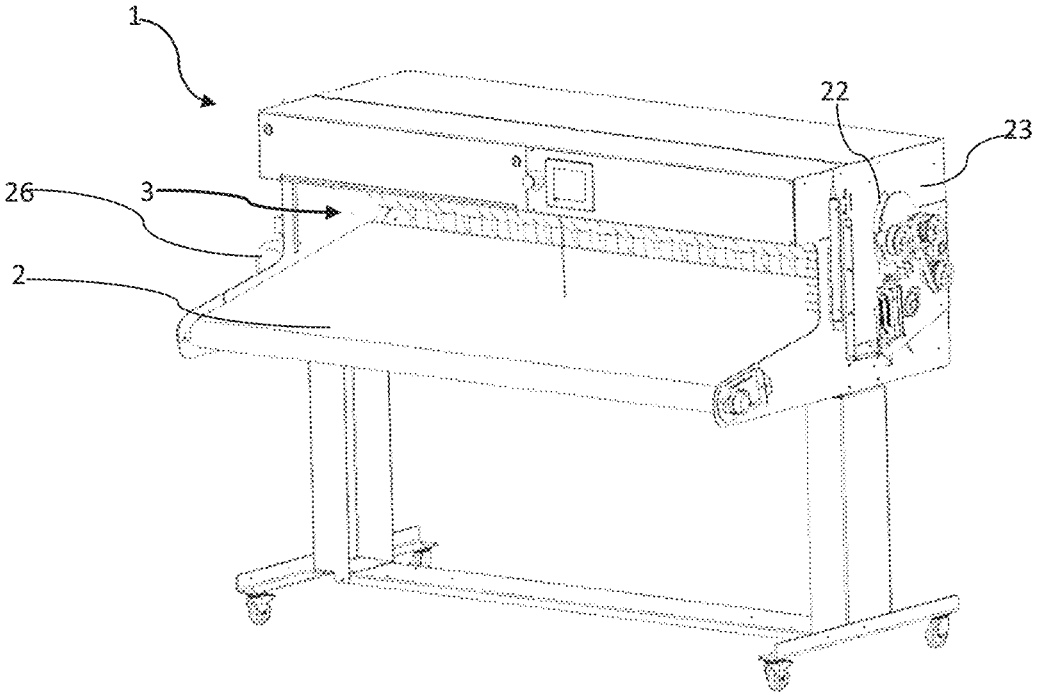
FIG. 1 shows a mat rolling mechanism in its entirety in a 3-D representation.

In FIG. 1 a mat rolling station 1 is disclosed, wherein a ramp conveyer 2 is provided, and as seen in FIGS. 2-5 the ramp conveyer 2 is to advance mats 4 in flattened out condition into a mat rolling mechanism 3, which performs the rolling up of a mat 4 in a tight mat roll 5. It is required that all the curls or windings in the roll 5 follow the same tangential direction throughout the entire roll as is the case with the rolled up mats 5 shown schematically in FIGS. 4 and 5.

Figure 8:
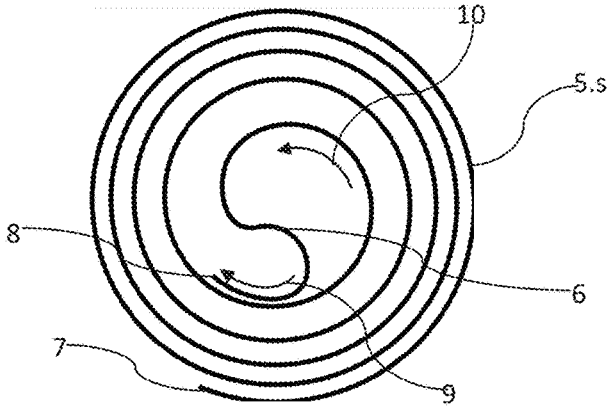
FIG. 8 is a side view of a rolled up mat, but with an un-desirable defect.

A rolled up mat 5.*s* which deviates from this desired roll pattern, is disclosed in FIG. 8. Here a so called S-fold 6 is shown in the center of the roll 5.*s*. As seen, the outer curls of the roll 5.*s* proceeds from the trailing edge 7 and counterclockwise, as indicated by arrow 10, around the roll 5.*s* and forms a spiral pattern towards the center of the roll 5.*s*. At the center point, close to the leading edge 8, the direction shifts and the leading edge 8 is folded to run clockwise as indicated by arrow 9 in the innermost part of the roll 5.*s*. When a mat, which is rolled with the S-fold at its innermost part is deployed on a floor, the sharp bend causing the shift from counterclockwise to clockwise curling up of the mat, may remain lodged in the fabrics of the mat, and the mat will thus fail to flatten out immediately, and thus a trailing edge 8 may stand up from the ground. Such upstanding edge is extremely hazardous as any person may be tripped by it and fall, which for elderly people can lead to grave conditions involving fracture of bones and even fatality.

Figure 12:
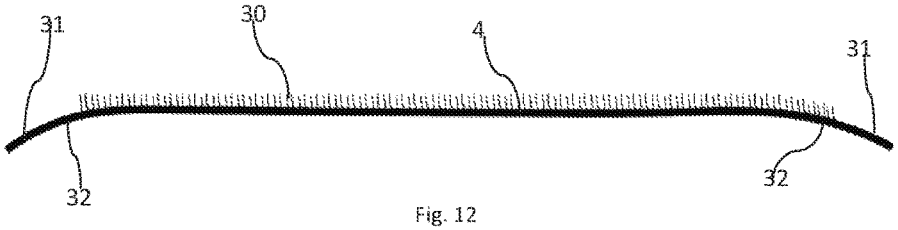
FIG. 12 shows a mat in a state, where it is not affected by any outside forces.
Figure 13:
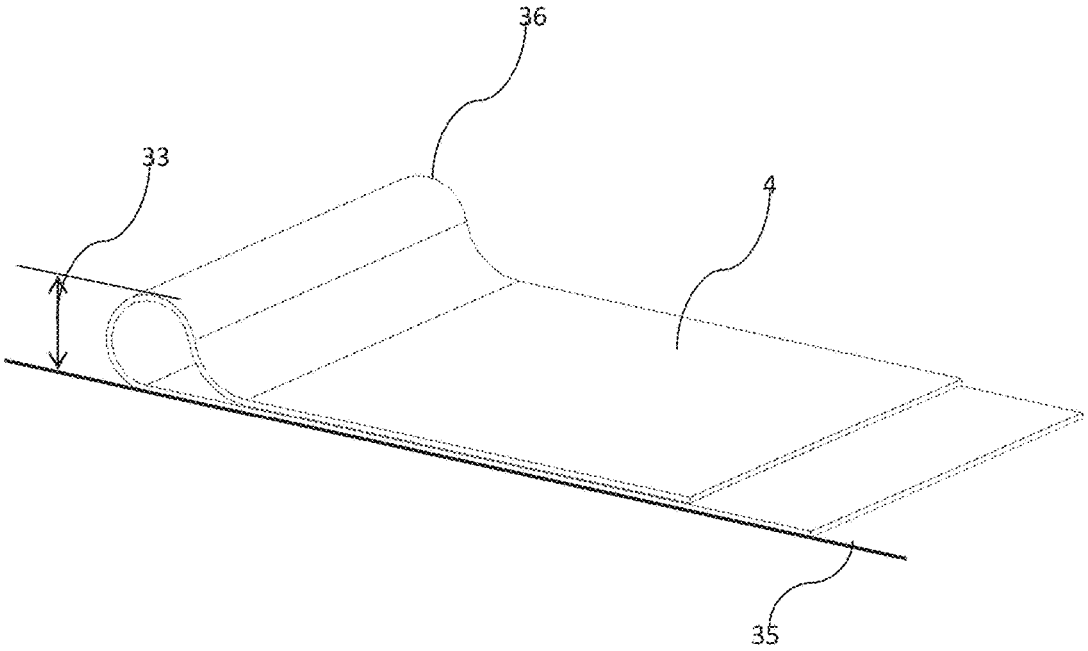
FIG. 13 is a folded over mat displaying a bead along the fold line.

The mat 4 in FIG. 12 is shown as it would arrange itself if no outside forces were at hand. The pile loaded parts 30 of the mat will position itself along the lines of a plane, and the end parts 31, which are without pile, will bend slightly away from the plane made up of the pile loaded side. When the mat 4 is diploid on a floor, gravitational pull on the pile loaded parts will cause it to lie flat and the slight bend 32 at the end parts are believed to make it even more un-likely that the mat deploys with up-standing end parts.

If a mat is stored for a longer time with an S-fold, which forces the slight bend 32 sharply in the opposite direction towards, and not away from the piled surface 30, this may result in a fold being created, which does not un-fold at deployment, and thus the hazardous up-standing end part is created.

Figure 2:
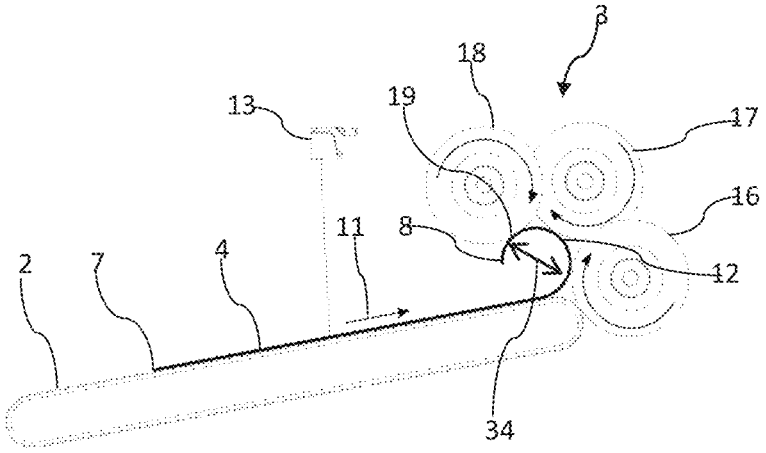
FIG. 2 shows a sectional view of the central element of the rolling mechanism in action with a mat.

The basic workings of the mat rolling station, is disclosed in FIGS. 2-5. As seen in FIG. 2, a mat 4 is initially placed in flattened out condition on ramp conveyer 2. The ramp conveyer 2 advances the mat 4, as indicated by arrow 11, into mat rolling mechanism 3. The mechanism 3 comprises a number of surfaces which move to bend leading edge 8 and following sections of the mat 4 to form a curl 12 on the ramp conveyer 2. As seen in FIG. 2, the curl 12 is initially made quite large, so this curl 12 may be made without excessive force.

Ideally it is desired, that the upper parts of the curl, by way of gravity would be able to keep the curl in place, even if the moving surfaces designed to shape the bend were removed. The ideal size of the diameter 34 of an initial curl 12 then relates to weight per unit area, and bending resilience of the mat and its thickness. It is to be understood that bending resilience may well differ according to which side of the mat, forms the outside of the curl.

To obtain the measure for a given mat 4, it is placed on a plane flat horizontal surface and folded in two equally long plies along a straight line perpendicular to the length direction of the mat 4. Hereby a bead 36 will form along the fold line and the size of this bead 36 measured as its height 33 from the surface 35, will correlate to the minimum diameter size of the initial roll or first curl 12 made when rolling up the mat. The initial curl diameter 34 should not be smaller than half the bead size 33, and preferably the initial curl diameter 34 is adjusted to form in the range between the bead size 33 and twice the bead size 33. As the initial curl diameter 34 when the mat 4 enters a particular mat rolling mechanism depends on many factors, such as speed and wear of rollers 16,17,18 this diameter for a particular mat type and size may be adjusted by trial and error by rolling the mat up with different adjustments of the position of the curl conveyer 18.

Figure 4:
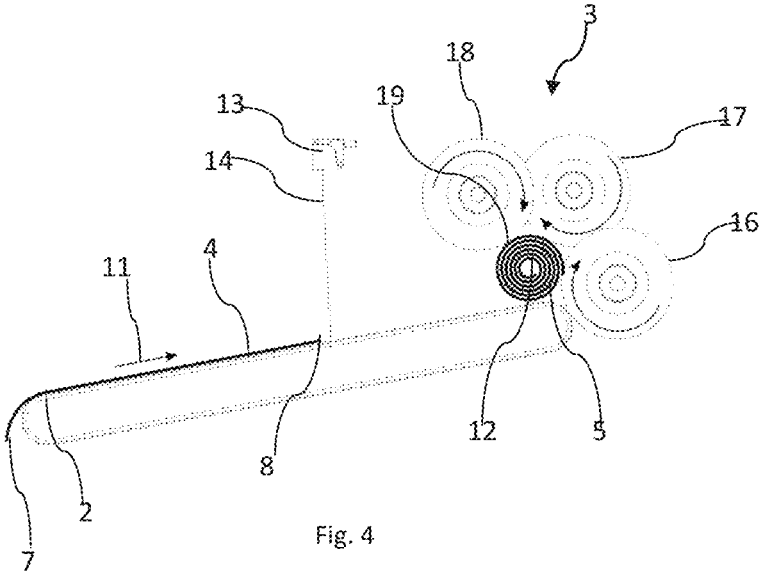
FIG. 4 shows the elements in FIG. 3 in action, but at a later time.
Figure 5:
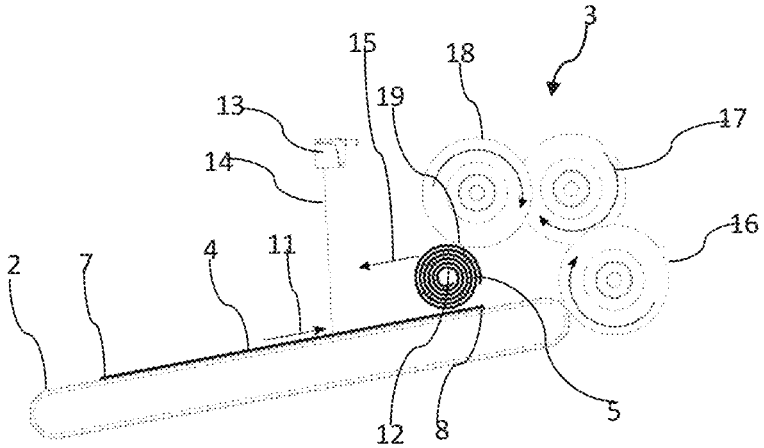
FIG. 5 shows the elements in FIG. 4 in action, but at a later time.

FIG. 4 shows the tight mat roll 5 in the mat rolling mechanism 3, while a succeeding mat 4 is advancing up along the ramp conveyer 2. A mat detector 13 is provided at the entrance of the mat rolling mechanism 3 and by way of radiation 14, the detector 13 may obtain a signal indicating whether or not a mat 4 is present on the ramp conveyer 2 below the detector 13. The detector 13 may comprise any kind of sensor, which depends on energy reflected off, or transmitted through the surface below it such as light, sound, x-ray, radio waves or any other known transmitted or present energy, which sensor technique may detect, in order to obtain a detection signal. The detection signal is served at the control unit in control box 28. In FIG. 5 the leading edge 8 of a mat has entered into the mat rolling mechanism 3 and at the same time, the curled up mat 5 exits the rolling mechanism 3 towards the same side it was entered into the mechanism 3. As indicated by arrow 15 the mat roll 5 travels against the direction, in which the mat 4 advances, but along the same path. This is possible in that mat roll 5, rolls on top of the succeeding mat 4, as this mat 4 advances up the ramp conveyer 2. This unique feature of the rolling station, allow the station to work without any idle time, as the operator does not have to wait for a mat to exit the rolling mechanism, before he serves a new mat onto the ramp conveyer.

The signal from the detector 13 is used in instigating the eject action of a rolled up mat 5, and here a suitable time delay may be introduced, if need be, to time the exit of the rolled up mat 5 to be aligned with the advance into the station of the proceeding mat, as may be seen in FIG. 5. As seen in FIGS. 2-5, the ramp conveyer 2 inclines upwards to the mat rolling mechanism 3, and thus the rolled up mat 5 ejected from the mechanism 3 will have a downhill roll to start with. This helps the rolled up mat to arrive swiftly for pick up by the operator at the entrance of ramp conveyer 2. During the operator pick up action, the succeeding mat 4 has already been positioned on the ramp conveyer 2 and is on its way towards the rolling mechanism 3, and as soon as the rolled up mat has been put aside, the operator may busy himself with adding the next mat to the ramp conveyer 2. Thus, neither operator nor mat rolling mechanism idles at any time during operation.

The mat rolling mechanism 3 is made up of a succession of bending conveyers, which advances the mat into a circular bend or curl 12, which builds up on the ramp conveyer 2. In the example of the invention shown in FIGS. 2-6, the following succession of conveyers are provided: lift conveyer 16 which lifts the mat up, return conveyer 17 which turns the mat to advance it in the opposite direction of the advance direction of ramp conveyer 2, and a curler surface 19 which bends the mat back to approach the ramp conveyer 2. Each of the bending conveyers 16, 17, 19 is disclosed as roll conveyers each comprising a large roll, but any type of conveyer may be used. Especially the curler surface 19 may comprise a guide surface or surfaces on which the advancing mat glides, as the forward pressure created by the previous succession of conveyers 16,17 may suffice to send the mat in the right direction to form a more or less circular curl 12, but in the presented embodiment, a curl conveyer 18 is used, so that the surface 19 is a moving surface and is constituted by a part of the outer rotating circumference of curl conveyer 18.

The roll conveyers 16, 17, 18 each constitute one cylindrical roll with resilient brush hairs standing radially out from the roll, and it is these brush hairs, which contacts the mat surface, and advances it in the tangential direction of movement of the cylindrical roll as it is rotated. As seen in FIGS. 2-5 the outer circular perimeter of the brush hairs of one cylindrical roll may well overlap the outer circular perimeter of the brush hairs of the next roll. As the brush hairs are arranged in circumferential disc shape areas, which alternates with bald areas along the length of each cylindrical roll, it is possible to arrange the hairs of one roll to enter the bald areas of adjacent rolls, so that the brush hairs does not impede the rotational drive of the rolls, even if they constitute circular circumferential surfaces which overlap one another. This may be seen in FIG. 9.

Figure 6:
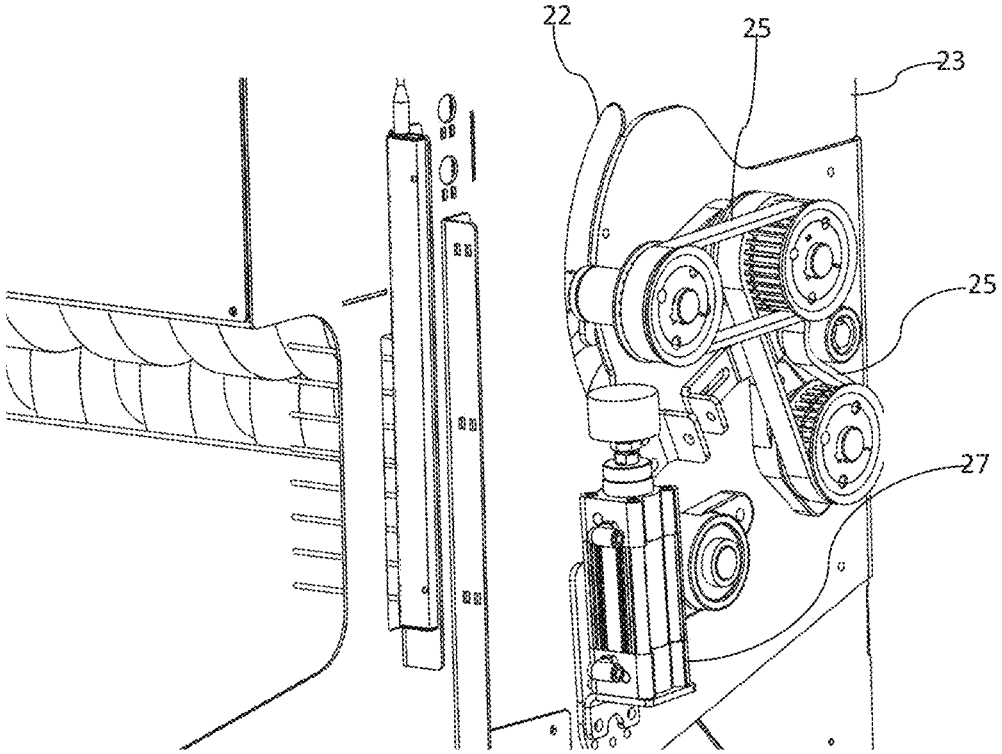
FIG. 6 is a perspective enlarged view of a detail from FIG. 1.
Figure 9:
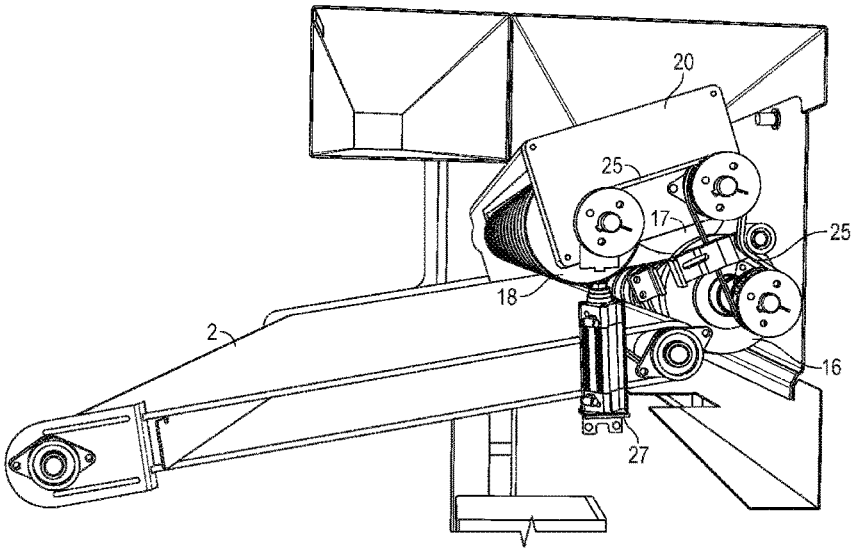
FIG. 9 is a perspective view of the internal parts of a mechanism.
Figure 11:
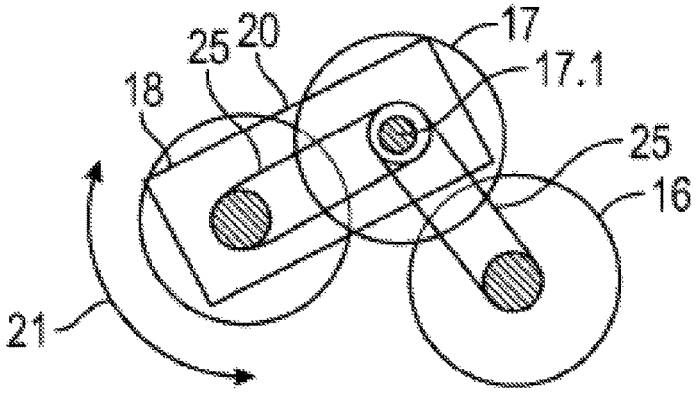
FIG. 11 shows schematics of the suspension used for the pivotally mounted curl conveyer.

As seen in FIG. 11 and FIG. 9, the curl conveyer 18 is mounted on a pivotally suspended arm 20. The pivot point of the arm 20 coinside with the suspension point of the return conveyer 17 and thus the curl conveyer 18 may pivot around the center of return conveyer 17 while the distance between return and curl conveyers 17,18 remains unchanged, as indicated in FIG. 11 where pivot arrow 21 shows the pivotal action of curl conveyer 18. As seen in FIG. 6, the pivotal action is guided by a cylindrical cam surface 22 which may be cut out from an end plate 23 of the rolling mechanism 3. The rotating shaft of the curl conveyer extends through the end plate 23, and may move along the cam surface 22. The cam surface 22 defines the pivotal end points and thus the range of circular movement in the direction of pivot arrow 21, which the curl conveyer may travel.

Figure 10:
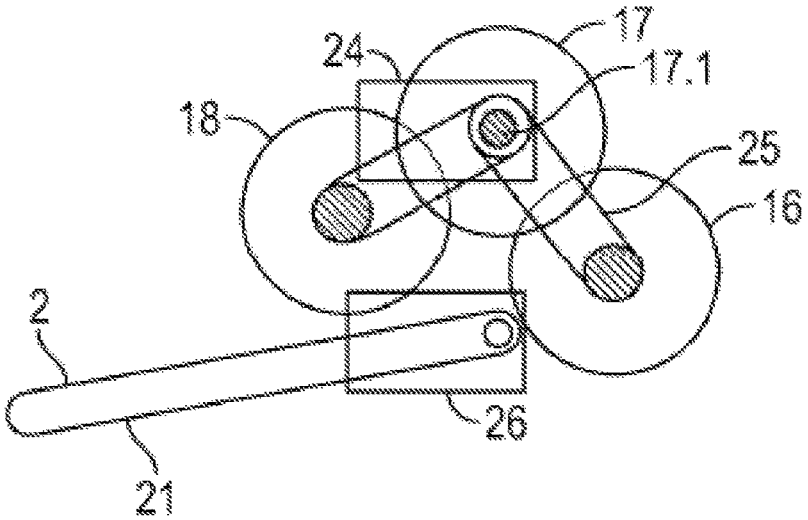
FIG. 10 is a schematic view showing how the motor drives the moving parts in the mechanism.

A motor 24 is dedicated the drive of the roller conveyers 16, 17, 18 and as indicated in FIG. 10 and FIG. 6, the motor 24 is directly connected to the drive shaft 17.1 of return conveyer 17, and by way of drive belts 25 the lift conveyer 16 and the curl conveyer 18 are driven in unison with return conveyer 17, and they thus have the same rotational speed. As they are also made with the same outer diameter, the surface speeds of each of lift conveyer 16, turn conveyer 17 and curl conveyer 18 are also the same. The rotational speed of drive motor 24 may be controlled as is known in the art. A further separate controllable motor 26 is provided in order to drive the ramp conveyer 2. Both motor 24 and further motor 26 are individually and independently controlled, so that the advance speed of the ramp conveyer 2 may be set independently of the circumferential speed of the three conveyers 16, 17, 18 driven by motor 24.

Figure 3:
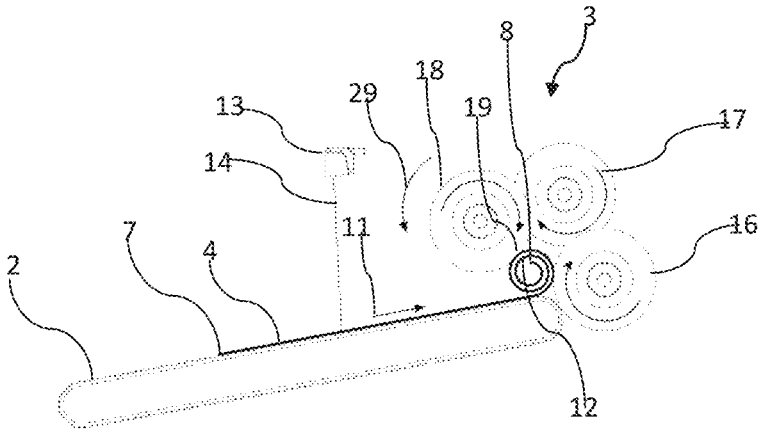
FIG. 3 shows the elements in FIG. 2 in action, but at a later time.
Figure 7:
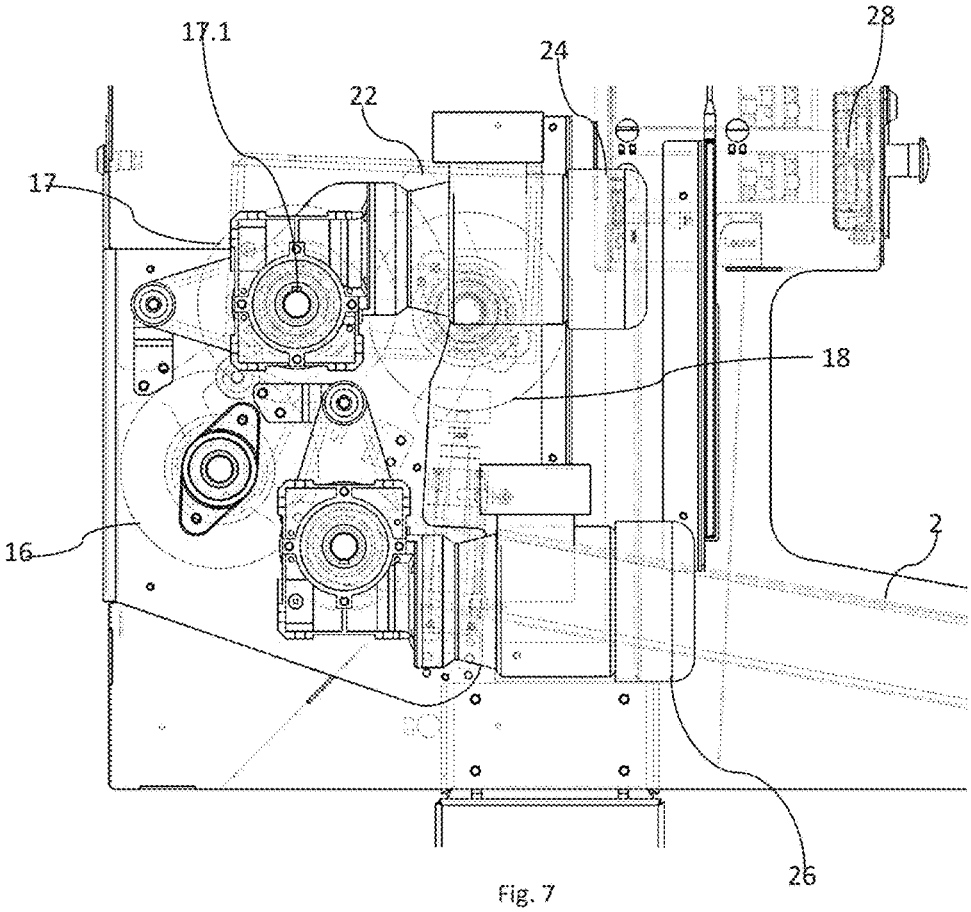
FIG. 7 is a side view of the mat rolling mechanism as in FIG. 6, but from the opposite side with X-ray display of internal structures.

As seen in FIG. 11 and also in FIG. 9, the arm 20 carries curl conveyer 18 at one end thereof, so the weight of the arm 20 and the conveyer will impart a gravitational pull of curl surface 19 towards the ramp conveyer 2, and this gravitational pull imparts a pinch action in direction of arrow 29 in FIG. 3. In order to lift the curl conveyer up, an actuator 27 is provided, which may lift up the arm 20 on the command of a control unit situated inside a box 28 indicated in FIG. 7. When the actuator 27 is activated, the arm 20 may be lifted to put the curl conveyer 18 and thus curl surface 19 in a highest position, and thus allow a large initial curl 12 to be shaped at the advance of a leading edge 8 of a mat 4 as indicated in FIG. 2.

Once a first curl 12 has formed, the actuator 27 may retract and cause a lowering of curl conveyer 18 towards the surface of ramp conveyer 2 and thereby cause a pinching action 29 of the initial curl 12, and subsequent curls, which are added by the combined movement of ramp conveyer 2 and lift conveyer 16, return conveyer 17 and curl conveyer 18. At some point, the actuator 27 is completely returned, and the entire weight of arm 20 and curl conveyer 18 rests on the mat roll 5, and this will result in a minimum size of the hole at the center of the mat roll. In the present embodiment, this size is determined by factors such as weight of the conveyer, possibly added mass to the arm 20, and mat properties.

It is possible to view the arm 20 as a weight arm and by adding mass to it at either the one or the other side of the suspension point, here the rotational center 17.1 of return conveyer 17, the pinch action may either be increased or decreased. It is also possible to completely balance out the weight of the curl conveyer 18 and control the entire pinch action by way of the actuator 27. This would require the actuator to be double acting and also to be fastened to the arm 20 and not just to provide a lifting force to the arm 20 as it is seen in FIG. 6, where the arm 20 is somewhat above the endpoint of the actuator 27.

When a rolled up mat 5 is residing and rotating in the rolling mechanism as seen in FIG. 4, the surface speeds of all the conveyers in touch with the mat roll 5 are the same. By increasing the surface speed of the bending conveyers 16, 17, 18 with respect to the ramp conveyer 2 the upper side of the roll 5 will advance faster than the lover side thereof. This difference in speed of upper and lower side of mat roll 5 will advance the entire roll 5 towards the lower end of ramp conveyer 2, and therefore the mat will eject from rolling mechanism 3. At the end of the ejection action, the mat roll will have a rotational speed, and thus a surface speed, which will exceed the speed of the ramp conveyer 2. This prevents the just ejected mat from being transported back into the rolling mechanism by ramp conveyer 2 on the surface of which it is rolling. The combined effect of ramp conveyer being enclined downwards towards its lover end, and the rotational inertia of the rotating rolled up mat 5, will ensure that the mat proceeds down the ramp conveyer 2 where it may be either picket up by an operator or roll out over the edge of the ramp conveyer 2 to be gripped by a tray or other implement not disclosed in the drawing.

REFERENCE NUMBERS

1 Rolling station
2 Ramp Conveyer
3 Mat rolling mechanism
4 Mat
5 Tight mat roll
6 S-fold
7 Trailing edge
8 Leading edge
9 Clockwise arrow
10 Counterclockwise arrow
11 Up ramp direction
12 Initial curl
13 Detector
14 Radiation
15 Downhill arrow
16 Lift conveyer
17 Return conveyer
18 Curl conveyer
19 Curl surface
20 Arm
21 Pivot arrow
22 Cylindrical cam surface
23 End plate
24 Motor
25 Drive belts
26 Further motor
27 Actuator
28 Control box
29 Pinch direction
30 Pile
31 End parts
32 Bend
33 Bead size
34 Initial curl diameter
35 Horizontal surface
36 Bead

What is claimed is:

1. A method for rolling up definite lengths of a mats in a unidirectional rolled mat roll, comprising:

advancing a plurality of mats one after another into a rolling mechanism in flattened out condition, and releasing each of the plurality of mats from the rolling mechanism in rolled up condition, wherein a first mat in the rolled up condition of the plurality of mats is ejected from the rolling mechanism and caused to roll out therefrom on top of a second succeeding mat in the flattened out condition of the plurality of mats advancing towards the rolling mechanism.

2. The method according to claim 1, wherein ejecting of the first mat in the rolled up condition from the rolling mechanism is initiated by a signal provoked by the advance of the second succeeding mat in the flattened out condition towards the rolling mechanism.

3. The method according to claim 1, wherein each of the plurality of mats are advanced towards the rolling mechanism along an upwards inclined ramp conveyer and each of the plurality of mats in the rolled up condition are configured to roll down the inclined ramp conveyer.

4. The method according to claim 1, wherein the first mat in the rolling mechanism is advanced at a predetermined input speed from an input side and advanced at a predetermined output speed from an output side wherein a higher output speed than input speed caused the ejection of the first mat.

5. The method according to claim 4, whereby a mat is advanced into the rolling mechanism along the inclined ramp, then in the rolling mechanism a mat section is advanced in a direction perpendicular to the ramp, where after the mat section is advanced parallel to the ramp to oppose the input direction towards a lower end of the ramp, and finally the mat section is advanced downwards towards the mat surface which mat surface is advancing up the ramp, thus forming an initial curl wherein the advancement of a mat section downwards towards the mat surface occurs at a predetermined distance from the mat surface on the ramp when forming the initial curl of a roll, and that as further layers are added, the diameter of the innermost layer is made gradually smaller and possibly reduced further after the entire mat has entered the rolling mechanism.

6. A method for serving a mat rolling station, wherein mats in flattened out condition are advanced on an upwardly inclined ramp conveyer from an input end thereof and conveyed into a rolling station and rolled into a multilayer mat roll, whereby a rolled up mat in the rolling station is caused to be ejected therefrom towards the input end of the inclined ramp conveyer rolling against the surface speed of the inclined ramp conveyer, and wherein the rolled up mat exiting the mat rolling station rolls on top of an advancing mat on the inclined ramp conveyer.

7. The method according to claim 6, wherein an exit action of the mat rolling station is initiated by a signal acquired from a mat detector at the inclined ramp conveyer said signal from the mat detector being provoked by the advance of a flattened out mat on the ramp conveyer.

8. The method according to claim 7, whereby an operator enters flattened out mats, one after another, on the ramp conveyer, and whenever a mat is residing in rolled up condition in the mat rolling station the operator receives this rolled up mat on top of a just entered mat whereby the operator may handle the rolled up mat for further transport while the just entered mat advances into the mat rolling station.

* * * * *